United States Patent [19]

Vicic et al.

[11] Patent Number: 4,518,144

[45] Date of Patent: May 21, 1985

[54] RAM-TYPE BLOWOUT PREVENTER AND PACKER THEREFOR

[75] Inventors: John C. Vicic, Houston; Carl A. La Velle, Spring; Joe P. Parris, III, Magnolia, all of Tex.

[73] Assignee: Cameron Iron Works, Inc., Houston, Tex.

[21] Appl. No.: 528,551

[22] Filed: Sep. 1, 1983

[51] Int. Cl.[3] ..... E21B 33/06

[52] U.S. Cl. ..... 251/1 A; 277/188 A

[58] Field of Search ..... 251/1 A; 277/27, 73, 277/127, 188 R, 188 A, 199

[56] References Cited

U.S. PATENT DOCUMENTS

| | | | |
|---|---|---|---|
| 2,194,258 | 3/1940 | Allen | 251/1 A |
| 4,044,988 | 8/1977 | Arzumanov et al. | 251/1 A |
| 4,089,534 | 5/1978 | Litherland | 277/188 A |
| 4,256,314 | 3/1981 | Berglund et al. | 277/27 |
| 4,310,139 | 1/1982 | Williams et al. | 251/1 B |
| 4,456,215 | 6/1984 | Bishop et al. | 251/1 B |

*Primary Examiner*—Samuel Scott
*Assistant Examiner*—Allen J. Flanigan
*Attorney, Agent, or Firm*—Vinson & Elkins

[57] ABSTRACT

An improved ram-type blowout preventer having a housing with a vertical bore and opposed, aligned ram guideways, a ram in each guideway, means for moving the rams inwardly and outwardly in the guideways, each ram having an improved ram front packer with a packing and means for directing the flow of the packing into a restricted opening at the face of the packer.

13 Claims, 7 Drawing Figures

RAM-TYPE BLOWOUT PREVENTER AND PACKER THEREFOR

BACKGROUND

Blowout preventers are used to maintain control of wells during drilling. Ram-type blowout preventers are used to close on the drill or pipe string to contain pressure in the well. At times it is necessary to strip the string through the closed rams. This stripping movement can severely wear or abrade the face of the resilient ram front packer. Another reason that the ram front packers of ram-type blowout preventers are subject to wear is that in order to provide a seal about the string they must move into tight engagement with the irregular surface of the string when closed and such ability causes the packers to be subject to extrusion. When the ram front packers have been subjected to excessive extrusion and must be replaced, the well pressure must be contained by excessive drilling mud weight and all drillingoperation stopped while the blowout preventer rams are removed and the ram front packers removed and replaced with new packers. This non-drilling "down time" is very expensive. The design of ram packers is thus a compromise to provide the needed feed or available movement of the material with maximum abrasion and extrusion resistance to provide the longest life possible.

Examples of prior ram-type blowout preventers can be seen in U.S. Pat. Nos. 2,883,141 and 3,692,316 which disclose the use of upper and lower anti-extrusion packer plates molded in the packing designed to minimize extrusion damage to the ram front packer. U.S. Pat. No. 2,194,257 discloses a blowout preventer with a ram front packer mounted in a tapered groove in the ram body and having upper and lower tapered anti-extrusion plates embedded in the packing. U.S. Pat. No. 2,237,709 discloses a ram-type blowout preventer with a dovetail groove in the face of the ram to retain a pressure responsive sealing member. U.S. Pat. No. 3,379,255 discloses a well string shearing device with a blind ram blowout preventer for sealing above the cutoff assembly. The ram front packer is composed of resilient material only without upper and lower anti-extrusion plates. The resilient material is not embedded or bonded to the ram, since it must be free to move forward when urged by movement of the stem and plunger head against the thrust plate. The faces of the rams engage when closed to contain the packing. U.S. Pat. No. 1,963,683 discloses a ram-type blowout preventer having segments mounted on screws above and below the packing to slide down responsive to the load of a drill collar to express rubber from the confining channel between the segments and the web of the ram and cause it to flow inwardly and sealingly engage the string.

SUMMARY

The present invention relates to an improved ram-type blowout preventer with an improved ram front packer. The preventer includes a housing with a bore therethrough and opposed, aligned ram guideways extending outward from the bore, a ram in each guideway, means for moving the rams inwardly and outwardly in the guideways, each of the rams having a removable front packer with upper and lower anti-extrusion plates having face recesses, packing between and molded to the plates and means extending into the packing from the face recesses of the plates to direct the packing movement or flow relative to the plates and inwardly to provide an improved seal against a string extending through the housing bore.

An object of the present invention is to provide an improved ram-type blowout preventer having extended service life without sacrificing sealing characteristics.

Another object of the present invention is to provide a ram-type blowout preventer having rams with improved ram packing rubber flow characteristics.

A further object of the present invention is to provide an improved ram-type blowout preventer with ram front packers having anti-extrusion plates which engage the string and direct the packing toward the string when closed thereon.

BRIEF DESCRIPTION OF THE DRAWINGS

These and other objects and advantages of the present invention are hereinafter set forth and explained with reference to the drawings wherein.

DESCRIPTION OF THE PREFERRED EMBODIMENTS

Figure 1:
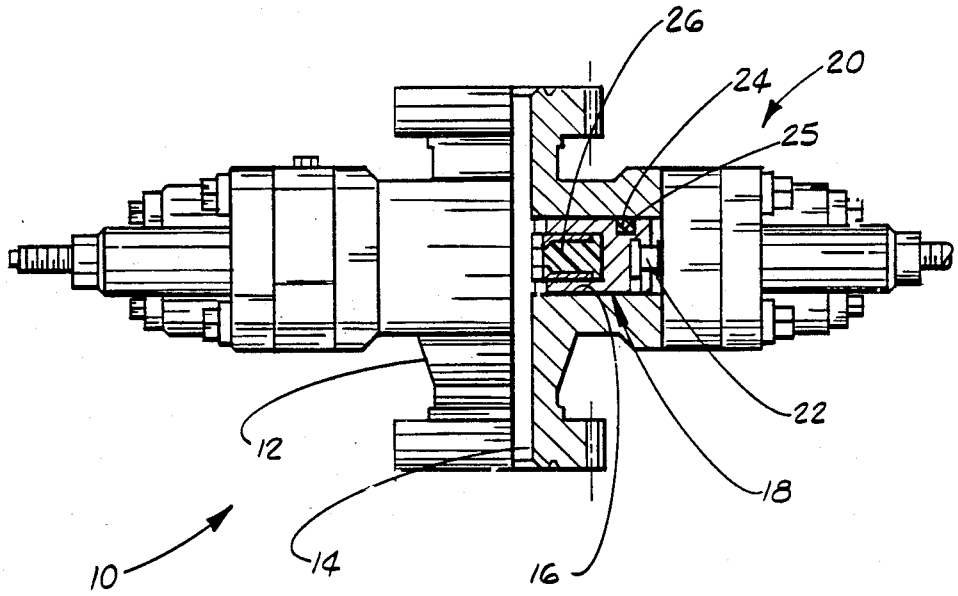
FIG. 1 is an elevation view, partly in section, through the improved ram-type blowout preventer.
Figure 2:
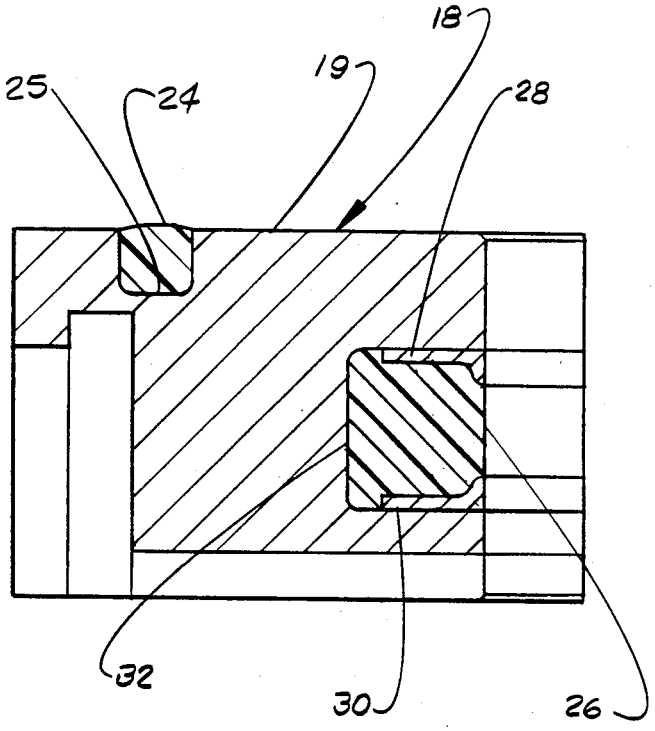
FIG. 2 is a sectional view of the improved ram of the blowout preventer of FIG. 1 but drawn enlarged.

Improved blowout preventer 10 is a ram-type preventer including housing 12 with vertical bore 14 therethrough and aligned ram guideways 16 extending outward through housing 12 from opposite sides of bore 14. One of rams 18 is positioned in each of guideways 16 and each ram 18 includes means 20, such as a piston (not shown), connected to ram 18 by connecting rod 22 for moving rams 18 inwardly and outwardly in guideways 16 to close or open bore 14. While only one guideway 16 and one ram 18 are shown it is to be understood that there are two opposed guideways 16 and a ram 18 in each guideway. Seal 24 extends across the top of each ram 18 in groove 25 in ram body 19 to provide a seal between ram 18 and the interior of guideway 16 and coacts with ram front packer 26 to retain well pressure below rams 18 when rams 18 are closed.

Figure 3:
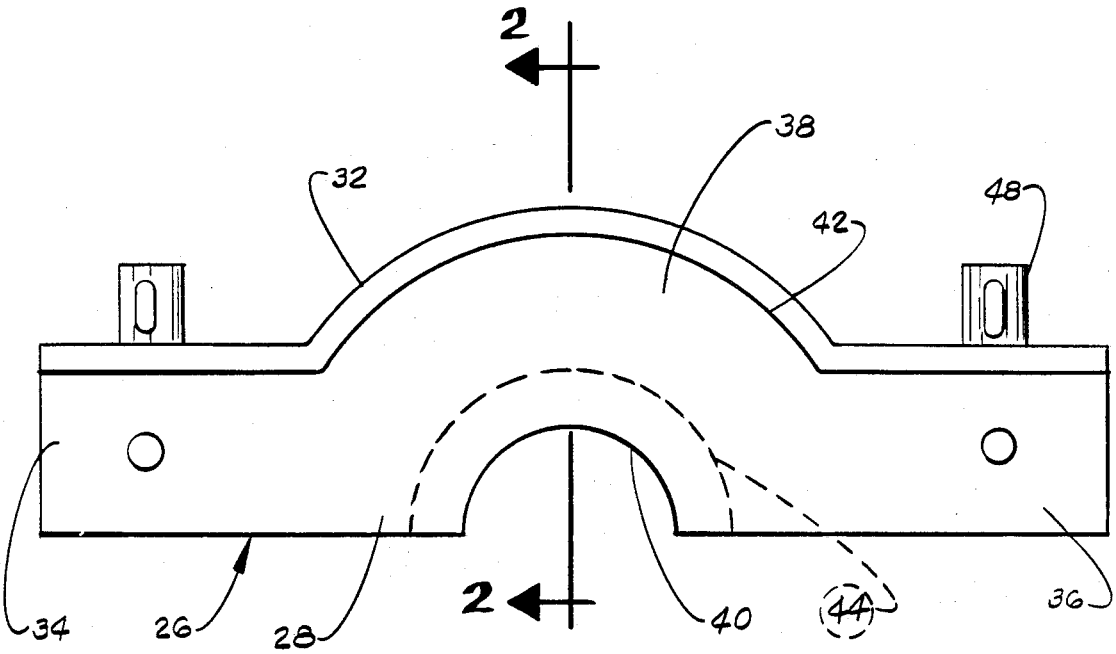
FIG. 3 is a plan view of the improved ram front packer of FIG. 1 and FIG. 2.
Figure 4:
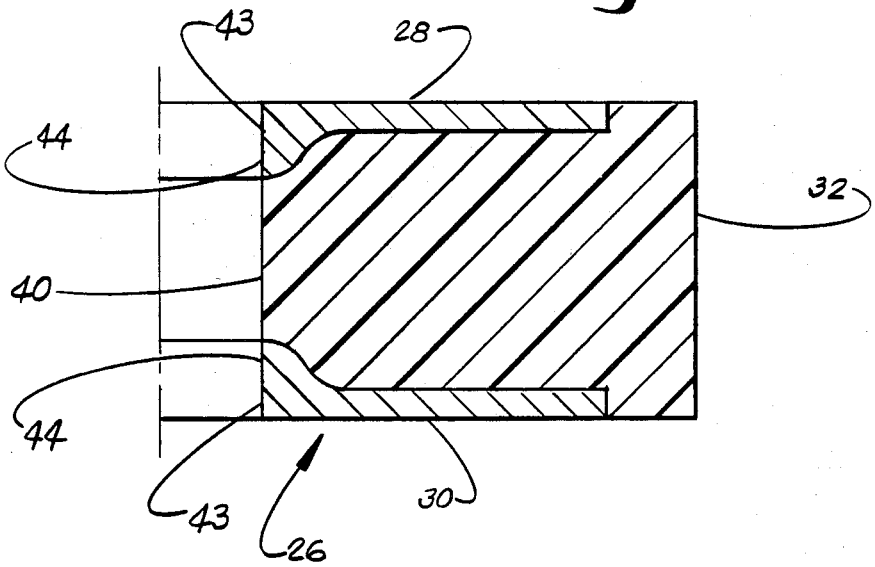
FIG. 4 is a sectional view of the packer taken along line 3—3 in FIG. 3 and rotated 90° clockwise.

Improved ram front packer 26 includes upper anti-extrusion plate 28, lower anti-extrusion plate 30 with packing 32 molded between and to plates 28 and 30. Plates 28 and 30 are elongated with outer portions 34 and 36 and central portion 38. Outer portions 34 and 36 are rectangular in shape and central portion 38 includes face recess 40 and rear projection 42. Pins 46 extend through packing 32 and connect between plates 28 and 30 and locking lugs 48 extend to the rear of packer 26 and are used to secure packer 26 within the recess on the front of rams 18. Arcuate guides 44 are integral with the inner surfaces 43 of plates 28 and 30 immediately around face recess 40 as best seen in FIGS. 3 and 4. Guides 44 are approximately quarter-round shape providing an opening for packing 32 which tapers to its smallest vertical dimension at face recess 40. This structure directs the flow of the packing material 32 smoothly into the space between guides 44 and radially inward on closing of rams 18 on a string. Guides 44 engage the drill or pipe string and act as anti-extrusion members to protect packing 32.

The improved packers of the present invention have been tested by closing with a drill string running through the recesses and simulated well pressure beneath the rams and reciprocating the drill string back and forth through the closed rams many cycles. Such tests were designed to simulate actual field usage of the improved packer and blowout preventer of the present invention and they showed a completely unexpected improvement in the life of the packer which lasted as long as ten times the life of a typical prior art packer. In one test the packer after having run through 5,000 cycles continued to maintain its seal and when removed it was found that its resilient packing material beneath the central portion 38 had been caused to flow to face recess 40 and thereby provided much more usable resilient packing material in the sealing area of face recess 40.

Figure 5:
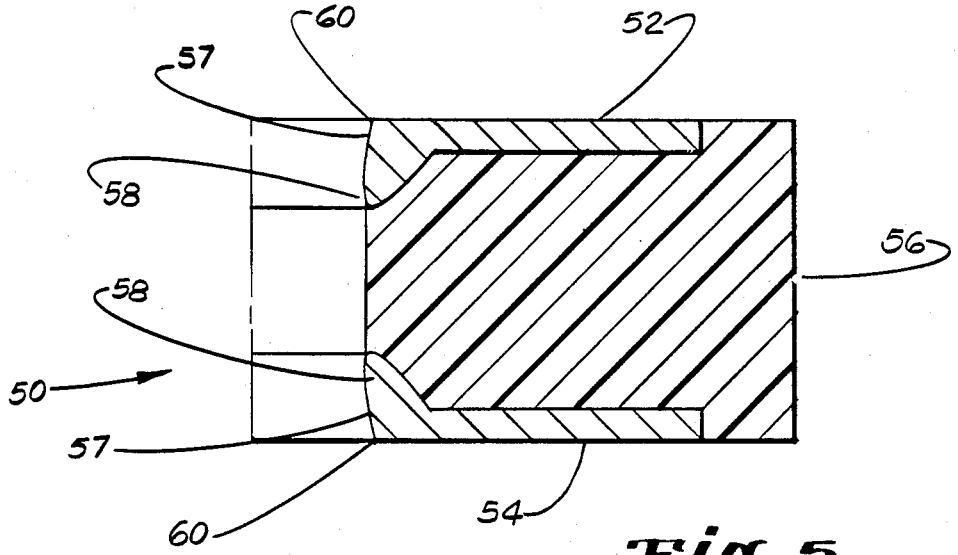
FIG. 5 is a similar sectional view of another form of ram front packer of the present invention.

Ram front packer 50 shown in FIG. 5 is similar to packer 26 and includes upper anti-extrusion plate 52, lower anti-extrusion plate 54, packing 56 molded between and to plates 52 and 54 and guides or lips 58 which are integral with and extend from inner surfaces 57 of plates 52 and 54 immediately around face recesses 60. Guides 58 are inclined radially inward and toward one another. The inner edges of lips 58 extend inward and have sufficient flexibility so that on closing of the rams they engage the string to provide a possible metal-to-metal seal thereabout and to prevent extrusion of packing 56. Lips 58 also function in a manner similar to guides 44 to direct the flow of packing smoothly into the space between lips 58 and radially inward on closing of the rams on a drill or pipe string.

Figure 6:
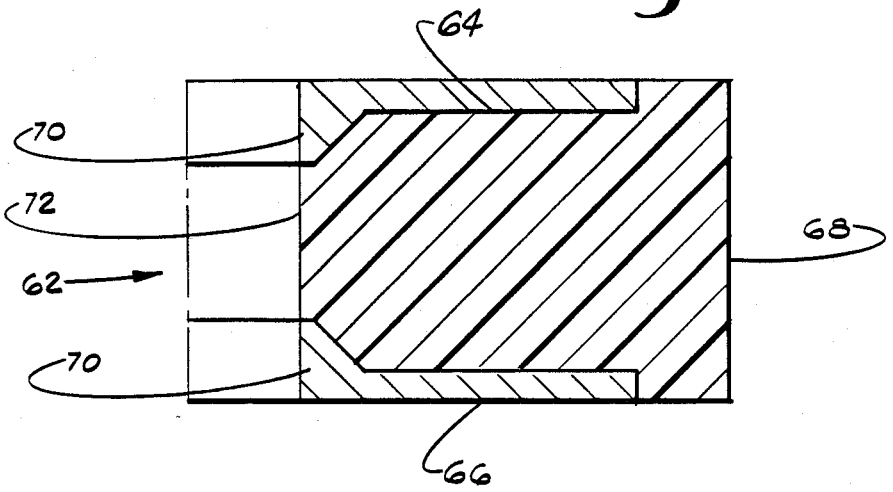
FIG. 6 is another similar sectional view of still another form of ram front packer of the present invention.

Ram front packer 62, shown in FIG. 6, is similar to packer 26 and includes upper anti-extrusion plate 64, lower anti-extrusion plate 66, and packing 68. Both plates 64 and 66 include integral tapered arcuate guides 70 on the inner surfaces of plates 64 and 66 immediately surrounding face recesses 72. Guide 70 provide a straight taper at an angle of approximately 45° as shown. It is believed that guides 70 also smoothly direct the flow of packing 68 on closing of the rams on a string.

Figure 7:
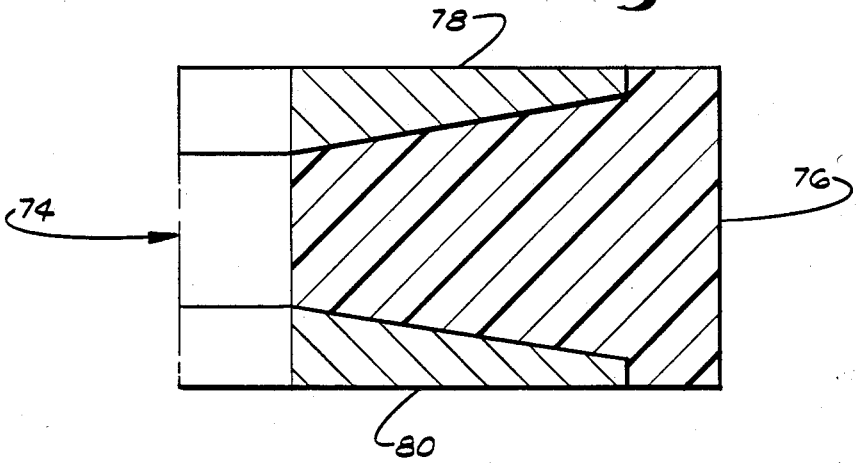
FIG. 7 is another similar sectional view of yet another form of ram front packer of the present invention.

Packer 74 shown in FIG. 7 is similar to the other packers shown in that it provides for the smooth direction of the flow of packing 76 inward toward the string against which it is to seal and the flow is also restricted to a preselected area. Packer 74 includes upper anti-extrusion plate 78, lower anti-extrusion plate 80 and packing 76 molded between and to plates 78 and 80. The inside surfaces of plates 78 and 80 in the central portion of packer 74 are tapered toward one another so that the rear portion of plates 78 and 80 are relatively thin as compared to the face of plates 78 and 80. Thus, plates 78 and 80 smoothly direct the flow of packing 76 to the restricted face area to assure sealing.

What is claimed is:

1. A ram-type blowout preventer comprising
a housing having a bore with aligned ram guideways extending through the housing from opposite sides of said bore,
a ram in each of said ram guideways,
means for moving the rams inwardly and outwardly in said guideways,
a removable ram-front packer in each of said rams including a packing having a front face, and
an upper plate embedded in the upper portion of the packing,
said upper plate having a front portion having a vertical dimension greater than the vertical dimension of its rear portion so that pressure on the packing ensures that the upper plate maintains sufficient support for said packing when closed.

2. A blowout preventer according to claim 1 wherein
said upper plate having a lower downwardly and inwardly tapered surface below the central portion of said upper plate.

3. A blowout preventer according to claim 1 wherein
said upper plate embedded in the upper surface of said having a lip adjacent its face surface depending downward and inward.

4. A blowout preventer according to claim 3 wherein said lip on said upper plate is designed to engage a well string as the rams are closed thereon.

5. A blowout preventer according to claim 4 wherein
said lip has sufficient flexibility to provide a metal-to-metal seal with the well string.

6. An improved ram front packer for a ram-type blowout preventer comprising
a packing having a front face, and
said upper plate having a front portion having a vertical dimension greater than the vertical dimension of its rear portion so that pressure on the packing ensures that the upper plate maintains sufficient support for said packing when closed.

7. A packer according to claim 6 wherein
said upper plate having a lower downwardly and inwardly tapered surface below the central portion of said upper plate.

8. A packer according to claim 6 wherein
said upper plate having a lip adjacent its face surface depending downwardly and inwardly.

9. A packer according to claim 8 wherein
said lip on said upper plate is designed to engage a well string as the rams are closed thereon.

10. A packer according to claim 8 wherein
said lip has sufficient flexibility to provide a metal-to-metal seal with the well string.

11. A ram-type blowout preventer comprising
a housing having a bore with aligned ram guideways extending through the housing from opposite sides of said bore,
a ram in each of said ram guideways,
means for moving the rams inwardly and outwardly from said guideways, and
a packer in the front face of each of said rams including an upper plate,
a lower plate, and
packing positioned between the plates,
the inner face of each of said plates extending a substantially greater distance toward the other plate than dose its rear portion.

12. A ram-type blowout preventer according to claim 11 wherein
at least one pair of said rams are blind rams adapted to close on each other.

13. A ram-type blowout preventer according to claim 11 wherein
at least one pair of said rams are pipe rams adapted to close and seal on a pipe string.

* * * * *

UNITED STATES PATENT AND TRADEMARK OFFICE

CERTIFICATE OF CORRECTION

PATENT NO. : 4,518,144

DATED : May 21, 1985

INVENTOR(S) : John C. Vicic et al.

It is certified that error appears in the above-identified patent and that said Letters Patent is hereby corrected as shown below:

Column 4, lines 17 and 18, delete "embedded in the upper surface of said".

line 18, "having" should read -- has --.

line 52, "from" should read -- in --.

line 59, "dose" should read -- does --.

Signed and Sealed this

*Thirteenth* Day of *May 1986*

[SEAL]

*Attest:*

DONALD J. QUIGG

*Attesting Officer*

*Commissioner of Patents and Trademarks*